US006047666A

United States Patent [19]

Ban et al.

[11] Patent Number: 6,047,666

[45] Date of Patent: Apr. 11, 2000

[54] HEAT GENERATOR

[75] Inventors: Takashi Ban; Shigeru Suzuki; Hidefumi Mori; Tatsuya Hirose, all of Kariya, Japan

[73] Assignee: Kabushiki Kaisha Toyoda Jidoshokki Seisakusho, Kariya, Japan

[21] Appl. No.: 09/148,757

[22] Filed: Sep. 4, 1998

[30] Foreign Application Priority Data

Sep. 10, 1997 [JP] Japan ..... 9-245259

[51] Int. Cl.[7] ..... F22B 3/06

[52] U.S. Cl. ..... 122/26; 126/247; 237/12.3 R

[58] Field of Search ..... 122/26, 27; 126/247; 123/142.5 R; 237/12.3 R, 12.3 B

[56] References Cited

U.S. PATENT DOCUMENTS

| | | | |
|---|---|---|---|
| 4,285,329 | 8/1981 | Moline | 126/247 |
| 4,733,635 | 3/1988 | Menard et al. | 122/26 |
| 5,755,379 | 5/1998 | Ito | 237/12.3 R |
| 5,788,151 | 8/1998 | Moroi et al. | 237/12.3 R |

*Primary Examiner*—Teresa Walberg
*Assistant Examiner*—Gregory A. Wilson
*Attorney, Agent, or Firm*—Morgan & Finnegan, L.L.P.

[57] ABSTRACT

A heat generator has a heating chamber and a pair of heat exchange chambers located adjacent to the heating chamber. The heating chamber includes inner walls and accommodates viscous fluid. A rotor is located in the heating chamber and has shearing surfaces facing the inner walls of the heating chamber. The rotor is rotated for shearing the viscous fluid that occupies the clearance between the inner walls of the heating chamber and the working surfaces thereby generating heat. Each inner wall includes a center region, which is located in the vicinity of the axis of the rotor, and a peripheral region, which surrounds the center region. Heat generated in the heating chamber is transferred to the heat exchange chambers and heats circulating fluid in the heat exchange chambers. Each inner wall includes grooves extending radially from the peripheral region to the center region. Each groove includes a bottom and a pair of side walls. The cross-section of each groove is U-shaped, without sharp corners, to prevent flow disturbances in the groove and to prevent wear of the mold that forms the grooves.

18 Claims, 4 Drawing Sheets

HEAT GENERATOR

BACKGROUND OF THE INVENTION

The present invention relates to a heat generator that is used as an auxiliary heat source for vehicles. More particularly, the present invention pertains to a heat generator that generates heat by shearing viscous fluid in a heating chamber with a rotor and transmits the generated heat to fluid such as engine coolant.

Typically, vehicles include hot-water type heaters, which have a heater core located in a heating duct. The heater core is supplied with engine coolant. Specifically, coolant is sent to the heater core after cooling the engine.

The heater core uses heat from the coolant to warm air in the duct. The warmed air is then supplied to the passenger compartment.

However, diesel engines and lean burn type engines have a relatively low heating value and thus are not able to heat engine coolant to a sufficient level. It is difficult to maintain the temperature of the coolant in the heater core at a predetermined temperature (for example, 80° C.). Therefore, hot-water type heaters deliver relatively little heat when mounted on vehicles having diesel engines or lean burn type engines.

In order to solve this problem, a heat generator located in a fluid circuit of engine coolant has been proposed for heating engine coolant. The heat generator includes a heating chamber and a heat exchange chamber, which are defined in a housing. The heater also includes a rotor, which is accommodated in the heating chamber and is rotated by the drive force of the engine. The rotor rotates to shear viscous fluid (for example, silicone oil having a high viscosity) in the heating chamber for generating heat based on fluid friction. The generated heat is used to heat circulating fluid (engine coolant) in the heat exchange chamber. The heated circulating fluid is used to warm the passenger compartment.

It is important to improve the efficiency of heat transfer from the heating chamber to the heat exchange chamber. Also, if the housing has a special structure for improving the heat transfer efficiency, it is important to stabilize the quality of the individual products in order to put the housing to practical use.

SUMMARY OF THE INVENTION

Accordingly, it is an objective of the present invention to provide a heat generator that efficiently transfer heat generated in a heating chamber to circulating fluid. Another objective of the present invention is to stabilize the quality of a heat generator housing, which defines the heating chamber.

To achieve the foregoing and other objectives and in accordance with the purpose of the present invention, an improved heat generator is provided. The heat generator includes a heating chamber, a rotor and a heat exchange chamber. The heating chamber includes an inner wall and accommodates viscous fluid. The rotor is located in the heating chamber. The rotor has a working surface facing the inner wall of the heating chamber and is rotated for shearing the viscous fluid in a clearance between the inner wall and the working surface thereby generating heat. The inner wall includes a center region, which is located in the vicinity of the axis of the rotor, and a peripheral region, which surrounds the center region. The heat exchange chamber is located adjacent to the heating chamber. Heat generated in the heating chamber is transferred to the heat exchange chamber and heats circulating fluid in the heat exchange chamber. Grooves are formed in the inner wall. The grooves extend from the peripheral region to the center region. The cross-section of each groove is U-shaped without sharp corners.

Other aspects and advantages of the invention will become apparent from the following description, taken in conjunction with the accompanying drawings, illustrating by way of example of the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A first embodiment of the present invention will now be described with reference to FIGS. 1–5.

Figure 1:
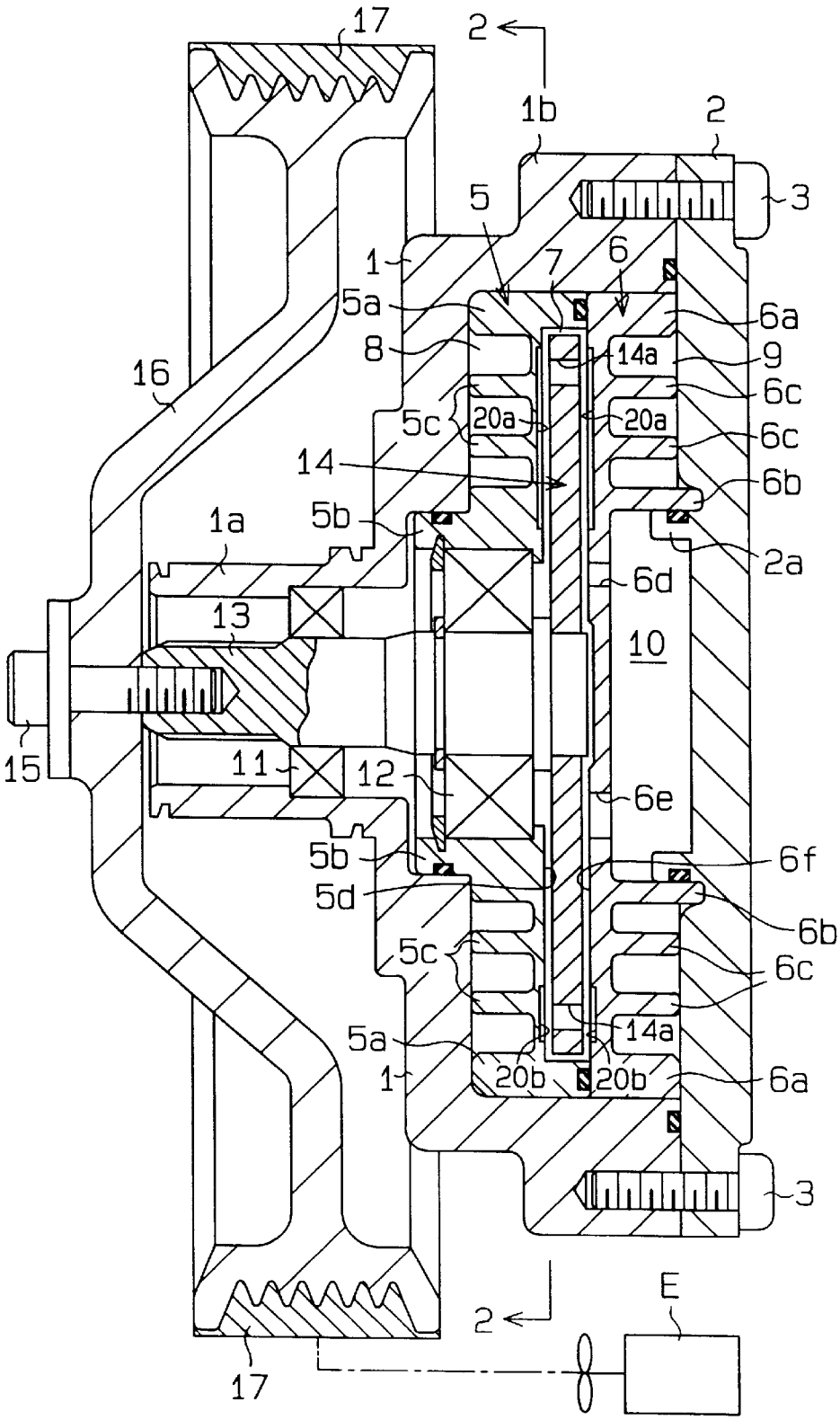
FIG. 1 is a cross-sectional view illustrating a viscous fluid heater according to a first embodiment of the present invention.

As illustrated in FIG. 1, an on-vehicle heat generator has a first housing 1 and a second housing 2. The first housing 1 includes a bowl-like cylinder 1*b* and a hollow cylindrical boss 1*a*, which protrudes forward (to the left as viewed in the drawing) from the cylinder 1*b*. The second housing 2 serves as a lid for covering the rear opening of the cylinder 1*b*. Specifically, the second housing 2 is secured to the first housing 1 by bolts 3 with a first dividing plate 5 and a second dividing plate 6 accommodated in the cylinder 1*b*.

Figure 2:
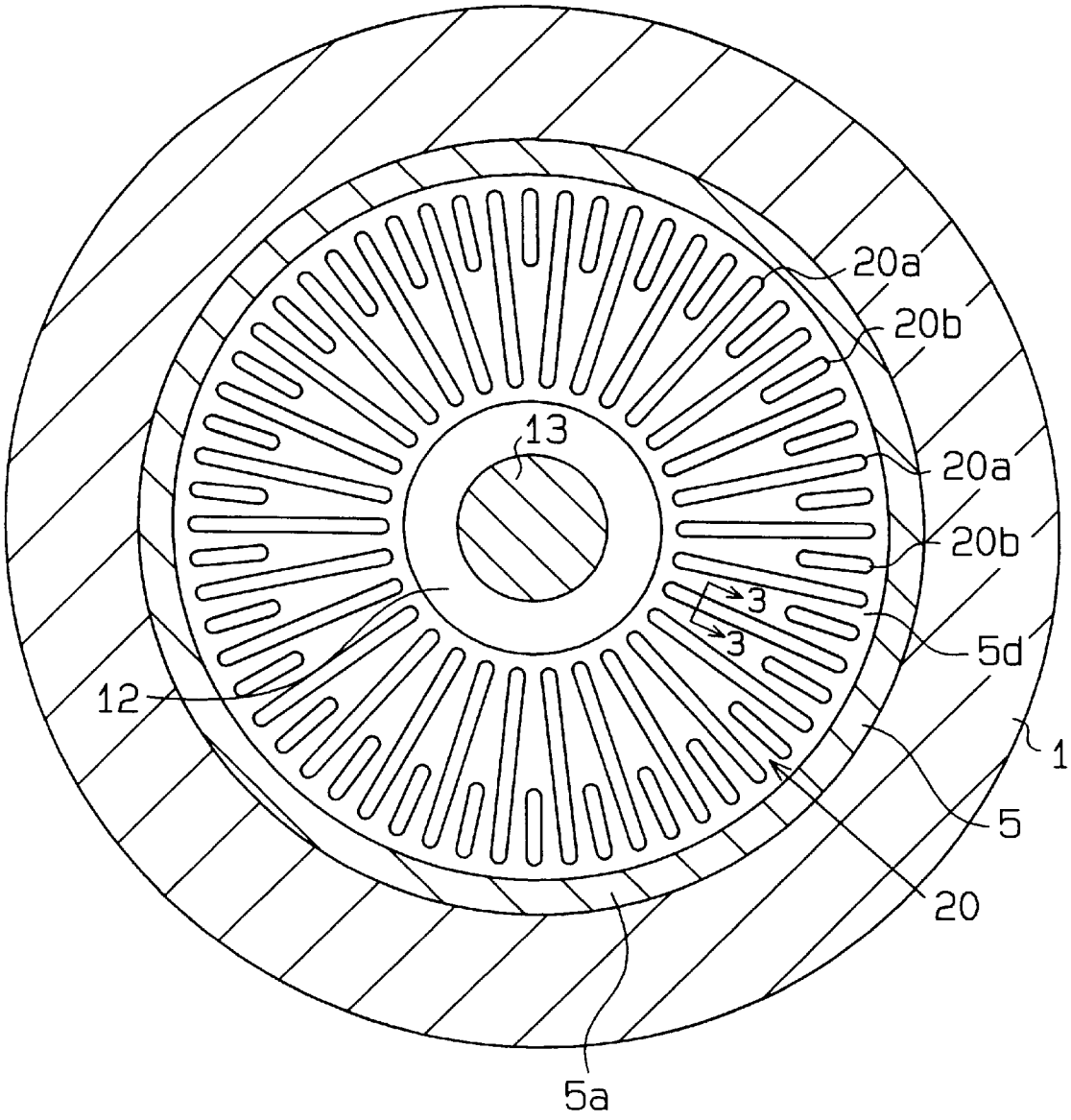
FIG. 2 is a cross-sectional view taken along line 2—2 of FIG. 1.

As illustrated in FIG. 2, the first dividing plate 5 has a peripheral rim 5*a*. The plate 5 also has a rear surface 5*d*, which defines a recess surrounded by the rim 5*a*. Radial grooves are formed in the rear surface 5*d*. The grooves include long grooves 20*a* and short grooves 20*b*, which are arranged alternately. The long grooves 20*a* extend radially from peripheral locations to central locations of the rear surface 5*d*. The short grooves 20*b* extend radially from peripheral locations toward the center of the rear surface 5*d* like the long grooves 20*a*, except that the short grooves 20*b* are shorter in the radial direction. Therefore, there are more grooves 20*a*, 20*b* in the peripheral portion than in the central portion of the rear surface 5*d*.

Figure 3:
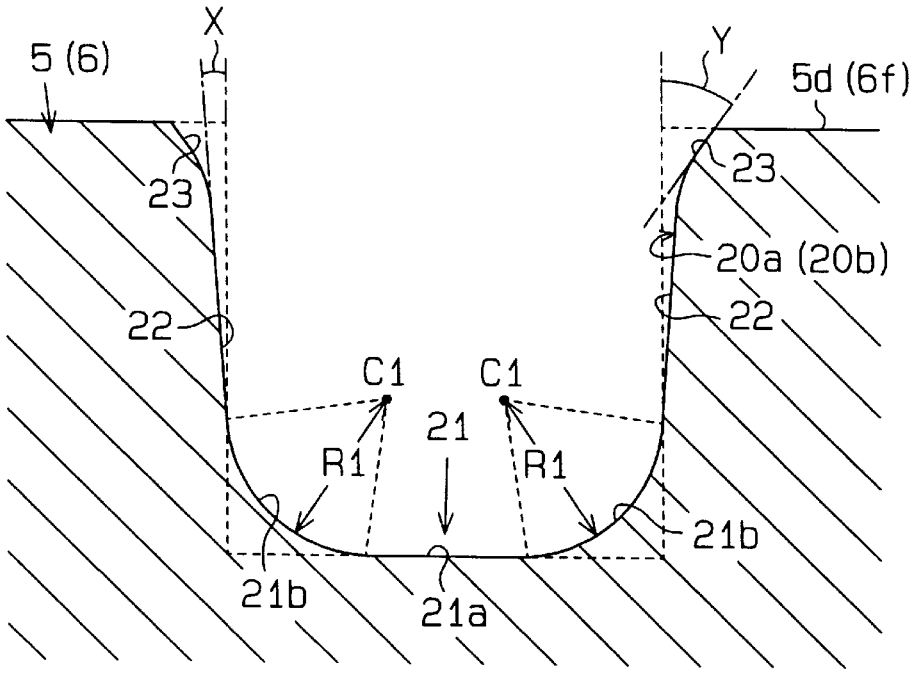
FIG. 3 is a cross-sectional view taken along line 3—3 of FIG. 2.

FIG. 3 is a cross-sectional view illustrating one of the long grooves 20*a*. The short grooves 20*b* have the same cross section as the long grooves 20*a*. As shown in FIG. 3, each long groove 20*a* has a bottom 21 and side walls 22, which are arranged on both sides of the bottom 21. The bottom 21 includes a flat portion 21*a* and curved portions 21*b* located to the sides of the flat portion 21*a*. The radius of curvature of each curved portion 21*b* is R1. The side walls 22 of the grooves 20*a*, 20*b* are formed such that the space between the walls 22 is wider toward the opening 23. Therefore the distance between the walls 22 increases toward the opening 23. Specifically, the walls 22 are inclined by an angle X from a plane that is perpendicular to the rear surface 5*d* of the first dividing plate 5 and parallel to the longitudinal axis of the groove, as shown in FIG. 3. Preferably, the angle X is between one degree and ten degrees. Also, the walls of the opening 23 are inclined by an angle Y from the same kind of plane. Preferably, the angle Y is between fifteen degrees and forty-five degrees.

As shown in FIG. 1, the second dividing plate 6 has an annular peripheral rim 6*a* on its rear face. The plate 6 includes a flat front surface 6*f*. As on the first dividing plate 5, long grooves 20*a* and short grooves 20*b* are also formed in the front surface 6*f*. The configuration of the grooves 20*a*, 20*b* is the same as that of the first dividing plate 5 (see FIG. 3).

The rims 5*a*, 6*a* are secured between the end walls of the housings 1, 2, which prevents movement of the plates 5, 6. A heating chamber 7 is defined between the plates 5, 6. The rear surface 5*d* of the first dividing plate 5 and the front surface 6*f* of the second dividing plate 6 are inner walls of the heating chamber 7. Both sets of grooves 20*a*, 20*b* are therefore located in the inner walls of the heating chamber 7.

The first housing 1, the second housing 2, the first dividing plate 5 and the second dividing plate 6, which constitute the housing of the on-vehicle heat generator, are made of aluminum or aluminum alloy. The plates 5, 6 are molded, for example, by die-casting.

As shown in FIG. 1, the first dividing plate 5 includes an inner cylindrical wall 5*b* extending forward from the center portion of its front face and fins 5*c* extending circularly about the cylindrical wall 5*b*. The first dividing plate 5 is located in the first housing 1 with the inner cylindrical wall 5*b* press fitted in a recess formed in the inner wall of the housing 1. The inner wall of the first housing 1 and the front face of the first dividing plate 5 define an annular front water jacket 8. The front water jacket 8 is located about the inner cylindrical wall 5*b* and adjacent to the heating chamber 7 and functions as a heat exchange chamber. The rim 5*a*, the cylindrical wall 5*b* and the fins 5*c* define channels of circulating water, or engine coolant, in the front water jacket 8.

The second dividing plate 6 includes an inner cylindrical wall 6*b* extending rearward from the central portion of its rear face and fins 6*c* extending circularly about the cylindrical wall 6*b*. When the second dividing plate 6 and the first dividing plate 5 are mated in the first hosing 1, the inner cylindrical wall 6*b* contacts a cooperating cylindrical wall 2*a* formed on the front face of the second housing 2. The inner wall of the second housing 2 and the rear face of the second dividing plate 6 define an annular rear water jacket 9. The rear water jacket 9 is located adjacent to the rear end of the heating chamber 7 and serves as a heat exchange chamber. The rim 6*a*, the inner cylindrical wall 6*b* and the fins 6*c* define channels for circulating water, or the engine coolant. The cylindrical wall 2*a* of the second housing 2 and the cylindrical wall 6*b* of the second dividing plate 2 define a reservoir, or sub-oil chamber 10.

The first housing 1 includes at least one inlet port (not shown) and at least one outlet port (not shown) on its side. The inlet port draws engine coolant to the water jackets 8, 9 from a heating circuit (not shown) of the vehicle, whereas the outlet port discharges engine coolant from the water jackets 8, 9 to the heating circuit.

As shown in FIG. 1, a drive shaft 13 extends through the first housing 1 and the first dividing plate 5. The shaft 13 is rotatably supported by a bearing 11 and a seal bearing 12. The seal bearing 12 is located between the cylindrical wall 5*b* and the drive shaft 13 for sealing the front end of the heating chamber 7. A disk-shaped rotor 14 is secured to the end of the shaft 13 and is accommodated in the heating chamber 7 to rotate integrally with the shaft 13. A narrow clearance is defined between the inner walls of the heating chamber 7 and the sides and the circumference of the rotor 14. The clearance is, for example, from tens to hundreds of micrometers. Bores 14*a* are formed in the peripheral portion of the rotor 14. The bores 14*a* are all located in the same distance from the axis of the drive shaft 13 and are spaced apart at equal angular intervals about the axis of the shaft 13.

The second dividing plate 6 includes upper and lower bores 6*d* and 6*e* , which communicate the heating chamber 7 with the sub-oil chamber 10. The cross-sectional area of the lower bore 6*e* is larger than that of the upper bore 6*d*.

The heating chamber 7 and the sub-oil chamber 10 constitute a fluid-tight inner space. The inner space accommodates a predetermined amount of silicone oil, which is viscous fluid. The amount of the silicone oil is determined such that the fill factor of the oil is fifty to eighty percent relative to the volume of the inner space at room temperature. Rotation of the rotor 14 draws the silicone oil out of the sub-oil chamber 10 to the heating chamber 7 through the lower bore 6*e*. At the same time, the silicone oil in the heating chamber 7 is returned to the sub-oil chamber 10 through the upper bore 6*d*. In other words, the silicone oil circulates between the heating chamber 7 and the sub-oil chamber 10. The level of the silicone oil in the sub-oil chamber 10 is lower than the upper bore 6*d* and higher than the lower bore 6*e*.

The front end of the drive shaft 13 is secured to a pulley 16 by a bolt 15. A V-belt 17 is engaged with the periphery of the pulley 16. The V-belt 17 operably couples the pulley 16 with a vehicle engine E.

The operation of the above on-vehicle heat generator will now be described.

When the drive shaft 13 is not rotating, the level of silicone oil in the heating chamber 7 is equal to the level of the silicone oil in the sub-oil chamber 10. Therefore, when the engine E starts rotating the drive shaft 13, the contact area between the rotor 14 and the silicone oil is relatively small. This allows the rotor 14 to be driven by a small torque. When the rotor 14 is rotated, the silicone oil in the sub-coil chamber 10 is drawn to the heating chamber 7 through the lower bore 6*e* due to its high viscosity and own weight. The silicone oil quickly fills the clearance between the walls of the heating chamber 7 and the rotor 14. The rotor 14 shears the silicone oil between the walls of the heating chamber 7 and the rotor 14. This heats the silicone oil. On the other hand, silicone oil is returned to the sub-oil chamber 10 through the upper bore 6*d*. In this manner, the silicone oil circulates between the heating chamber 7 and the sub-oil chamber 10. The returned oil temporarily stays in the sub-oil chamber 10. This lowers the temperature of the silicone oil. Accordingly, the silicone oil is prevented from being damaged by prolonged high temperatures.

Figure 4A:
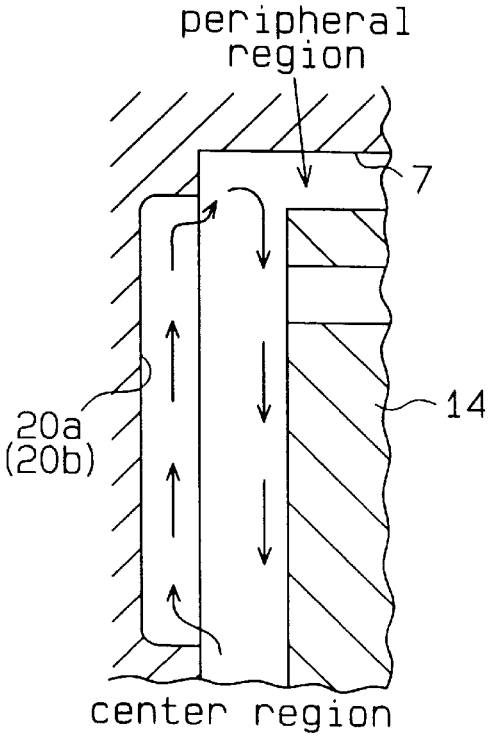
FIG. 4(A) is an enlarged partial cross-sectional view illustrating the flowing direction of viscous fluid when the Weissenberg effect dominates the centrifugal effect.

Rotation of the rotor 14 causes the silicone oil to flow in radial directions of the rotor 14 in the clearance between each shearing surface of the rotor 14 and the corresponding inner wall of the heating chamber 7. When the rotor 14 starts rotating or when the rotor 14 is rotating at a low speed, silicone oil in the heating chamber 7 is affected more by the Weissenberg effect than by centrifugal force. In this case, silicone oil that is located close to the rotor's shearing surface flows to the center portion of the heating chamber 7 along the shearing surface as illustrated in FIG. 4(A). Silicone oil in the center portion of the heating chamber 7 is guided by the long and short grooves 20*a,* 20*b* on the plates 5, 6 toward the peripheral region of the heating chamber 7.

Figure 4B:
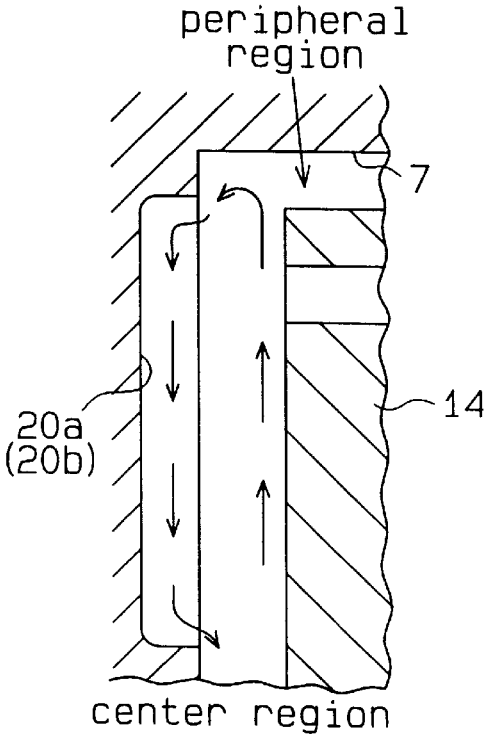
FIG. 4(B) is an enlarged partial cross-sectional view illustrating the flowing direction of viscous fluid when the centrifugal effect dominates the Weissenberg effect.

On the other hand, when the rotor 14 is rotated at a high speed, silicone oil is affected more by centrifugal force than by the Weissenberg effect. In this case, silicone oil close to the rotor's shearing surface is guided to the peripheral region of the heating chamber 7 as illustrated in FIG. 4(B). Silicone oil in the peripheral region is quickly moved back to the center region along the grooves 20*a,* 20*b.* In this manner, the circulation direction of silicone oil in the heating chamber 7 changes in accordance with the rotational speed of the rotor 14. The grooves 20*a,* 20*b* facilitate the circulation of the silicone oil.

Figure 5:
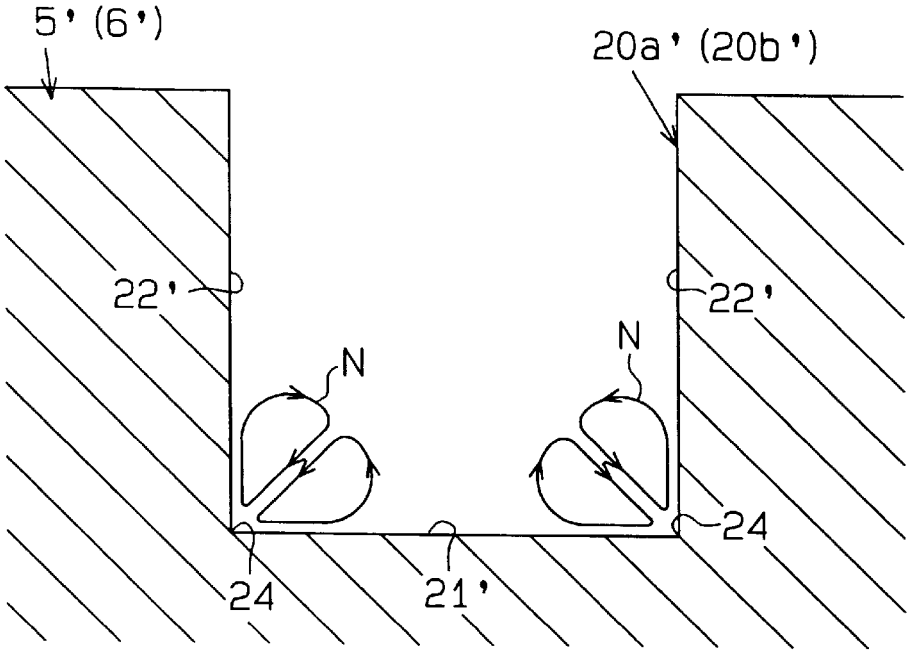
FIG. 5 is a cross-sectional view like FIG. 3 illustrating eddies of viscous fluid in a groove of a comparison example, which has right-angled corners.

As shown in FIG. 5, if a groove 20*a′,* 20*b′* has a square cross-section, its corners 24 of the bottom wall 21' and the side walls 22' are square. Oil flowing in the longitudinal direction (the direction perpendicular to the surface of the sheet of FIG. 5) of the groove 20*a′,* 20*b′* generates a secondary flow N as eddies at the corners 24. The secondary flow N disturbs the oil flow as a primary flow along the groove 20*a′,* 20*b′.*

However, the grooves 20*a,* 20*b* in the embodiment of FIGS. 1–4 have the curved portions 21*b* instead of square corners and therefore do not generate the secondary flow N. The rounded grooves 20*a,* 20*b* smooth and thus improve the flow of silicone oil along the grooves 20*a,* 20*b.* In order to prevent the secondary flow N, the ratio of the width of the groove to its depth is preferably greater than 0.5 and smaller than 2. Further, the side walls 22 of the grooves 20*a,* 20*b* are inclined, or tapered, such that the grooves 20*a,* 20*b* become wider toward the opening 23. This construction facilitates introduction of silicone oil into the grooves 20*a,* 20*b.*

If the groove 20*a′,* 20*b′* of FIG. 5 is formed by die-casting, the mold will be worn by repetitive casting of plates 5', 6'. Specifically, the mold for casting the groove 20*a′,* 20*b′* of FIG. 5 must have a projection corresponding to the groove's shape, and the projection must include corners that correspond to the right-angled corners 24 of the groove 20*a′,* 20*b′.* Repetitive usage of the mold wears the corners of the projection. This will result in deformed shapes of the corners 24 and variations in the shape of the grooves. However, the grooves 20*a,* 20*b* according to the embodiment of FIGS. 1–4 have rounded corners. Therefore, the mold for forming the grooves 20*a,* 20*b* has projections with rounded corners. This construction prevents the projections from being worn and stabilizes the quality of the plates 5, 6. Also, since the side walls 22 become wider toward the upper end of the grooves 20*a,* 20*b,* the plates 5, 6 are easily removed from the mold.

Heat generated by shearing silicone oil with the rotor 14 is transferred to coolant in the water jackets 8, 9 through the dividing plates 5, 6. At this time, the grooves 20*a,* 20*b* allow the silicone oil in the grooves 20*a,* 20*b* to flow quickly. Faster flow of the silicone oil improves the heat exchange efficiency between the silicone oil and the walls of the grooves 20*a,* 20*b.* That is, heat exchange efficiency between a wall and fluid flowing along the wall is affected by the speed of the fluid flow as well as by the temperature difference between the wall and the fluid. The heated coolant is supplied to the heating circuit (not shown) to warm the passenger compartment.

The heat generator of FIGS. 1–4 has the following advantages.

When the rotor 14 is rotating, silicone oil is guided by the grooves 20*a,* 20*b* on the dividing plates 5, 6 and circulates between the center region and the peripheral region of the heating chamber 7. In the grooves 20*a,* 20*b,* the corners between the bottom 21 and the side walls 22 are rounded. Therefore, the flow of silicone oil in the grooves 20*a,* 20*b* are not disturbed. This improves the heat exchange efficiency between the heat exchange chamber 7 and the water jackets 8, 9 through the dividing plate 5, 6.

The long and short grooves 20*a,* 20*b* dramatically improve the heat exchange efficiency from the heating chamber 7 to the water jackets 8, 9. In other words, the heat of the sheared silicone oil in the heating chamber 7 is efficiently transferred. The silicone oil is therefore not heated beyond its heat tolerance level. This extends the life of the viscous fluid heater.

The disk-shaped rotor 14 causes the relative speed between the rotor 14 and the viscous fluid to be higher in the peripheral portion of the rotor 14. This causes the temperature of the viscous fluid at the rotor periphery to be higher than that of the fluid near the rotor center. The long and short grooves 20*a,* 20*b* are alternately formed in the inner walls 5*d,* 6*f* of the heating chamber 7. There are more grooves 20*a,* 20*b* in the peripheral portion than in the central portion of the inner walls 5*d,* 6*f.* This construction encourages heat exchange from the heating chamber 7 to the water jacket 8, 9 at the peripheral region of the heating chamber 7, where the temperature of the silicone oil is relatively high. In other words, the grooves 20*a,* 20*b* improve the heat exchange efficiency where it is most important.

In the grooves 20*a,* 20*b,* the corners between the bottom 21 and the side walls 22 are rounded. In order to die-cast the dividing plate 5, 6, a mold must be used. The mold must have protrusions, the corners of which correspond to the rounded corners of the grooves 20*a,* 20*b.* The rounded corners of the protrusions are less vulnerable to wear compared to the protrusions of the mold for forming the square groove 20*a′* 20*b′* of FIG. 5. Therefore, the rounded shapes of the grooves 20*a,* 20*b* improve the durability of the casting apparatus. In other words, the casting apparatus is able to continue casting the plates 5, 6 without significantly changing the shapes of the grooves 20*a,* 20*b.*

The embodiment of FIGS. 1–4 may be modified as follows.

Figure 6:
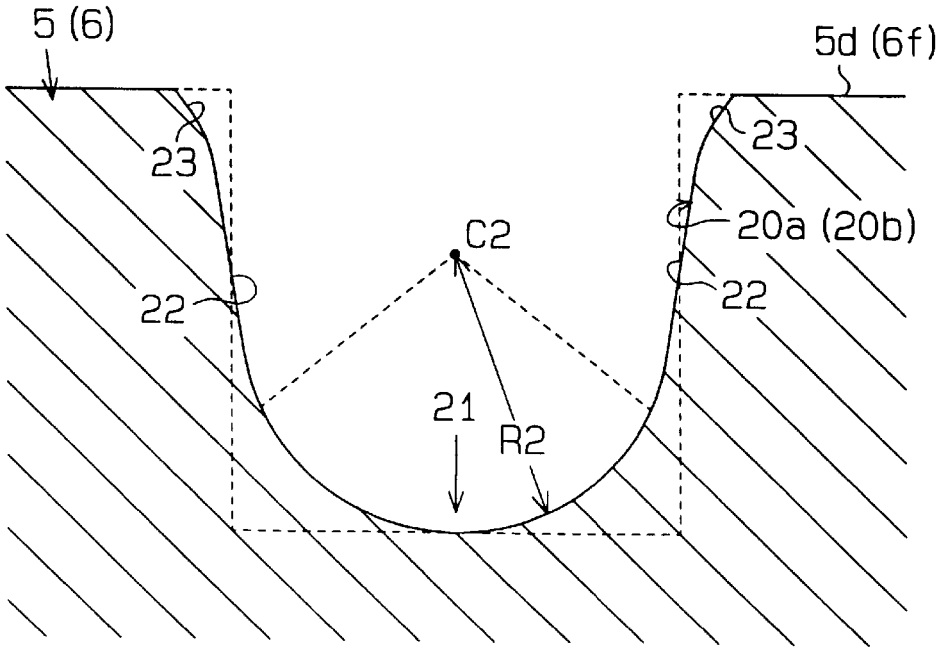
FIG. 6 is a cross-sectional view like FIG. 3 illustrating a second embodiment of the present invention.

As illustrated in FIG. 6, the bottom 21 may be a curved surface that has a single center C2 of curvature. That is, the bottom 21 of the grooves 20*a,* 20*b* may have a circular cross-section. In this case, the center C2 of curvature is preferably close to the center of the grooves 20*a,* 20*b.* This equalizes the distance from points on the bottom 21 to the center of the grooves 20*a,* 20*b.* Thus, the velocity distribution of the silicone oil in the grooves 20*a,* 20*b* varies uniformly in all directions from the center of the grooves 20*a,* 20*b,* which is ideal. The flow of silicone oil is therefore further facilitated. As a result, the heat exchange efficiency from the heating chamber 7 to the water jackets 8, 9 through the dividing plates 5, 6 is further improved.

The term "viscous fluid" in this specification refers to any type of medium that generates heat based on fluid friction when sheared by a rotor. The term is therefore not limited to silicone oil.

What is claimed is:

1. A heat generator comprising:

a heating chamber, which includes an inner wall and accommodates viscous fluid;

a rotor located in the heating chamber, wherein the rotor has a working surface facing the inner wall of the heating chamber and is rotated for shearing the viscous fluid in a clearance between the inner wall and the working surface thereby generating heat, and wherein the inner wall includes a center region, which is located in the vicinity of the axis of the rotor, and a peripheral region, which surrounds the center region;

a heat exchange chamber located adjacent to the heating chamber, wherein heat generated in the heating chamber is transferred to the heat exchange chamber and heats circulating fluid in the heat exchange chamber; and a plurality of grooves formed in the inner wall, wherein the grooves extend from the peripheral region to the center region, and wherein the cross-section of each groove is U-shaped without sharp corners.

2. The heat generator according to claim 1, wherein each groove has a pair of opposed side walls and a bottom, wherein the bottom includes a flat middle portion and rounded corner portions, and wherein the corner portions are connected to the side walls, respectively.

3. The heat generator according to claim 1, wherein each groove has a pair of opposed side walls and a bottom, the bottom being a curved surface with a constant-radius curvature.

4. The heat generator according to claim 1, wherein the number of grooves in the peripheral region of the inner wall is greater than that in the center region.

5. The heat generator according to claim 4, wherein the grooves include long and short grooves, which are alternately arranged about the axis of the rotor.

6. The heat generator according to claim 5, wherein the long grooves radially extend from the peripheral region of the inner wall to the center region, and wherein the short grooves radially extend only in the peripheral region.

7. The heat generator according to claim 1, wherein the side walls of each groove are inclined relative to a reference plane perpendicular to the inner wall and parallel to the longitudinal axis of each groove such that the distance between the side walls increases from the bottom toward the opening of the groove.

8. The heat generator according to claim 7, wherein the angle of the inclination of the side walls with respect to the reference plane is from one degree to ten degrees.

9. The heat generator according to claim 7, wherein the angle of the inclination of the side walls is greater in the vicinity of the opening of the groove.

10. The heat generator according to claim 9, wherein inclination of the side walls in the vicinity of the opening of the groove is from fifteen degrees to forty-five degrees with respect to the reference plane.

11. The heat generator according to claim 7, wherein the angle of the inclination of the side walls is greater in the vicinity of the opening of the groove.

12. The heat generator according to claim 11, wherein inclination of the side walls in the vicinity of the opening of the groove is from fifteen degrees to forty-five degrees with respect to the reference plane.

13. An on-vehicle heat generator comprising:

a heating chamber for accommodating viscous fluid, wherein the heating chamber includes a pair of facing inner walls;

a rotor located in the heating chamber, wherein the rotor includes a pair of working surfaces each of which faces one of the inner walls, wherein the rotor is rotated for shearing the viscous fluid in clearances between the inner walls and the working surfaces thereby generating heat, and wherein each inner wall includes a center region, which is located in the vicinity of the axis of the rotor, and a peripheral region, which surrounds the center region;

a heat exchange chamber located adjacent to the heating chamber, wherein heat generated in the heating chamber is transferred to the heat exchange chamber and heats circulating fluid in the heat exchange chamber;

a plurality of grooves formed in each inner wall, wherein the grooves extend radially from the peripheral region to the center region for promoting the radial flow of the viscous fluid, wherein the grooves include long and short grooves, which are alternately arranged about the axis of the rotor, wherein the long grooves extend from the peripheral region of the associated inner wall to the center region, wherein the short grooves extend only in the peripheral region, and wherein the cross-section of each groove is U-shaped without sharp corners.

14. The heat generator according to claim 13, wherein each groove has a pair of opposed side walls and a bottom, wherein the bottom includes a flat middle portion and rounded corner portions, and wherein the corner portions are connected to the side walls, respectively.

15. The heat generator according to claim 13, wherein each groove has a pair of opposed side walls and a bottom, the bottom being a curved surface with a constant-radius curvature.

16. The heat generator according to claim 13, wherein the side walls of each groove are inclined relative to a reference plane perpendicular to the inner wall and parallel to the longitudinal axis of each groove such that the distance between the side walls increases from the bottom toward the opening of the groove.

17. The heat generator according to claim 16, wherein the angle of the inclination of the side walls with respect to the reference plane is from one degree to ten degrees.

18. An on-vehicle heat generator driven by a vehicle engine, the heat generator comprising:

a heating chamber for accommodating viscous fluid, wherein the heating chamber includes a pair of facing inner walls;

a rotor, which is located in the heating chamber and is driven by the engine, wherein the rotor includes a pair of working surfaces, each of which faces one of the inner walls, wherein the rotor is rotated for shearing the viscous fluid in clearances between the inner walls and the working surfaces thereby generating heat, and wherein each inner wall includes a center region, which is located in the vicinity of the axis of the rotor, and a peripheral region, which surrounds the center region;

a heat exchange chamber located adjacent to the heating chamber, wherein heat generated in the heating chamber is transferred to the heat exchange chamber and heats circulating fluid in the heat exchange chamber;

a plurality of grooves formed in each inner wall, wherein the grooves extend radially from the peripheral region to the center region for promoting the radial flow of the viscous fluid, wherein the grooves include long and short grooves, which are alternately arranged about the axis of the rotor, wherein the long grooves extend from the peripheral region of the associated inner wall to the center region, wherein the short grooves extend only in the peripheral region, and wherein the cross-section of each groove is U-shaped without sharp corners; and a reservoir located adjacent to the heating chamber, wherein the viscous fluid circulates between the heating chamber and the reservoir during rotation of the rotor.

* * * * *